US009513088B2

(12) United States Patent
Dolan et al.

(10) Patent No.: US 9,513,088 B2
(45) Date of Patent: Dec. 6, 2016

(54) PROTECTIVE UNDERGARMENT

(71) Applicant: W. L. Gore & Associates, Inc., Newark, DE (US)

(72) Inventors: John Dolan, Centerville, DE (US); Matthew Murphy, Newark, DE (US); Raymond Minor, Elkton, MD (US); Shekoufeh Shahkarami, Ontario (CA); Joseph Krummel, Rising Sun, MD (US)

(73) Assignee: W. L. Gore & Associates, Inc., Newark, DE (US)

( * ) Notice: Subject to any disclaimer, the term of this patent is extended or adjusted under 35 U.S.C. 154(b) by 531 days.

(21) Appl. No.: 13/854,557

(22) Filed: Apr. 1, 2013

(65) Prior Publication Data

US 2013/0273343 A1 Oct. 17, 2013

Related U.S. Application Data

(60) Provisional application No. 61/791,047, filed on Mar. 15, 2013, provisional application No. 61/621,701, filed on Apr. 9, 2012, provisional application No. 61/618,996, filed on Apr. 2, 2012.

(51) Int. Cl.
*F41H 1/02* (2006.01)
*F41H 5/04* (2006.01)

(52) U.S. Cl.
CPC ..... *F41H 1/02* (2013.01); *F41H 5/0485* (2013.01); *Y10T 428/249921* (2015.04)

(58) Field of Classification Search
CPC .... B32B 2437/00; B32B 2571/02; F41H 1/02; F41H 5/0485; A41D 31/0055; A41D 19/01505;D06N 2209/103; Y10T 428/249921
See application file for complete search history.

(56) References Cited

U.S. PATENT DOCUMENTS

| | | | | |
|---|---|---|---|---|
| 4,194,041 | A | 3/1980 | Gore | |
| 5,155,867 | A | 10/1992 | Norvell | |
| 5,590,420 | A | 1/1997 | Gunn | |
| 5,721,283 | A | 2/1998 | Howard, Jr. et al. | |
| 7,296,394 | B2 | 11/2007 | Clough et al. | |
| 7,571,493 | B1 * | 8/2009 | Purvis et al. | 2/2.5 |
| 2002/0043631 | A1 | 4/2002 | DeMeo et al. | |
| 2003/0106130 | A1 | 6/2003 | Reynolds | |
| 2003/0170453 | A1 | 9/2003 | Foss et al. | |
| 2009/0077724 | A1 | 3/2009 | Courtney | |

(Continued)

FOREIGN PATENT DOCUMENTS

| | | |
|---|---|---|
| CA | 2250802 | 12/1989 |
| DE | 19641849 | 4/1998 |

(Continued)

OTHER PUBLICATIONS

International Search Report of PCT/US2013/034872 dated Jul. 30, 2013.

*Primary Examiner* — Scott R Walshon
(74) *Attorney, Agent, or Firm* — Kilpatrick Townsend & Stockton, LLP

(57) ABSTRACT

An insert for a protective garment, the insert having a fabric having at least 45 percent by weight of expanded polytetrafluoroethylene fibers, the fabric having a 2-Grain V-50 Fragmentation Resistance of at least 700 feet per second and a FAST-2 Bending Rigidity of less than 40 microNewton-meters.

17 Claims, 4 Drawing Sheets

(56) References Cited

U.S. PATENT DOCUMENTS

| | | | | |
|---|---|---|---|---|
| 2009/0178187 | A1 | 7/2009 | Nelson et al. | |
| 2011/0129657 | A1 | 6/2011 | Clough | |
| 2011/0203449 | A1 | 8/2011 | Ardiff et al. | |
| 2011/0214559 | A1* | 9/2011 | Lampo | B32B 37/00 89/36.02 |
| 2011/0217504 | A1* | 9/2011 | Lampo | B32B 3/02 428/76 |

FOREIGN PATENT DOCUMENTS

| | | |
|---|---|---|
| EP | 0765611 | 9/1996 |
| WO | WO 95/10749 | 4/1995 |
| WO | WO 03074770 A1 * | 9/2003 |
| WO | WO2008/091382 | 7/2008 |

* cited by examiner

PROTECTIVE UNDERGARMENT

RELATED APPLICATION

The present application claims priority to U.S. Provisional Patent Application No. 61/791,047 filed Mar. 15, 2013; which in turn claims priority to U.S. Provisional Patent Application No. 61/621,701 filed Apr. 9, 2012; and which in turn claims priority to U.S. Provisional Patent Application No. 61/618,996 filed Apr. 2, 2012.

FIELD OF THE INVENTION

The present invention relates to a protective undergarment (PUG).

BACKGROUND OF THE INVENTION

A PUG is an undergarment article similar to briefs and is used to protect the wearer from minor projectiles such as shrapnel, building debris, sand, and fragments due to an explosion occurring near the article wearer. The PUG may be the briefs themselves, or it may take the form of an insert fitted into a pocket in the crotch of the briefs. A common test to rate the PUG's effectiveness for stopping small projectiles is known as the V-50 2-grain fragment test.

Known PUGs are made of high strength fibers such as Kevlar and Nomex. Although such PUGs made of these materials satisfy the V-50 2-grain fragment test, they are very uncomfortable to wear. Another known PUG is made of silk. Although silk helps the wearer feel more comfortable, many layers of the silk must be used to satisfy the V-50 2-grain fragment test. As a result, the PUG is bulky and heavy. Moreover, silk fibers weaken with moisture (as do Kevlar and Nomex), so they risk failing the V-50 2-grain fragment test, and thus not protecting the wearer, if the wearer gets wet.

A PUG that satisfies the V-50 2-grain fragment test and is comfortable to the wearer, without being bulky or subject to weakening by moisture, is desirable.

SUMMARY OF THE INVENTION

The inventors have surprisingly discovered that an insert for a protective undergarment can be constructed using a high percentage of expanded polytetrafluoroethylene (ePTFE) fibers and still satisfy the applicable V-50 ballistic protection criteria. The amount of ePTFE fibers is equal to or greater than about 45% by weight, preferably greater than 50%, 55%, 65%, 75%, 85%, and even 95%, and most preferably 100% ePTFE fibers.

Including such a high percentage of ePTFE fibers greatly enhances the comfort of the undergarment, while still maintaining excellent ballistic protection. EPTFE fibers also provide distinct advantages such as water resistance, antimicrobial protection, and maintains strength even when wet (unlike silk and Kevlar, for example).

More specifically, one embodiment of invention provides an article comprising an insert for a protective garment, the insert comprising a fabric having at least 50 percent by weight of expanded polytetrafluoroethylene fibers, the fabric having a 2-Grain V-50 Fragmentation Resistance of at least 700 feet per second and a FAST-2 Bending Rigidity of less than 40 microNewtonmeters. Preferably, the fabric has at least 75 percent by weight of polytetrafluoroethylene fibers, and most preferably it is 100 percent by weight of polytetrafluoroethylene fibers. Preferably, the fabric has a 2-Grain V-50 Fragmentation Resistance of at least 800 feet per second. Preferably, the fabric has a Vertical Wicking after 10 minutes of less than 150 mm, and more preferably the fabric has a Vertical Wicking after 10 minutes of zero mm. Preferably, the FAST-2 Bending Rigidity is less than 30 microNewtonmeters, less than 20 microNewtonmeters, and most preferably about 10 microNewtonmeters.

In another embodiment, the invention provides an article comprising an insert for a protective garment, the insert comprising a fabric having at least 50 percent by weight of expanded polytetrafluoroethylene filaments having a tenacity of less than about 10 grams per dtex, the fabric having a 2-Grain V-50 Fragmentation Resistance of at least 700 feet per second and the fabric having a weight of less than about 160 grams per square meter. Preferably, the fabric has a weight of less than about 140 grams per square meter, and most preferably, less than about 120 grams per square meter.

In yet another embodiment, the invention provides an article comprising an insert for a protective garment, the insert comprising a fabric having at least 50 percent by weight of expanded polytetrafluoroethylene fibers, the fabric having a 2-Grain V-50 Fragmentation Resistance of at least 700 feet per second and a FAST-2 Bending Rigidity of less than 40 microNewtonmeters; and the fabric having a weight of less than about 160 grams per square meter.

In a preferred embodiment of the invention, the insert is designed to fit into a pouch in the crotch area of the undergarment. In alternative embodiments, the pouch itself, or the crouch area without a pouch-insert type construction, or even the entire protective undergarment may be constructed of the ePTFE fibers.

DETAILED DESCRIPTION OF THE INVENTION

Because the ePTFE fibers have a relatively low tenacity compared to the material set of fibers commonly used for ballistic protection, it is surprising that the insert provides the adequate V-50 protection. EPTFE fibers typically have a tenacity value of well less than 10 grams/dtex, while traditional ballistic fibers generally have a tenacity value of well above 10 grams/dtex. One skilled in the art would typically be motivated to decrease the weight percentage of ePTFE fibers in favor of the higher tenacity fibers. It is also surprising that the ePTFE fiber insert can be constructed of only two layers and still provide adequate protection, although additional layers are used in alternative embodiments. It is even conceivable that for some applications even one layer may provide adequate protection.

Figure 1:
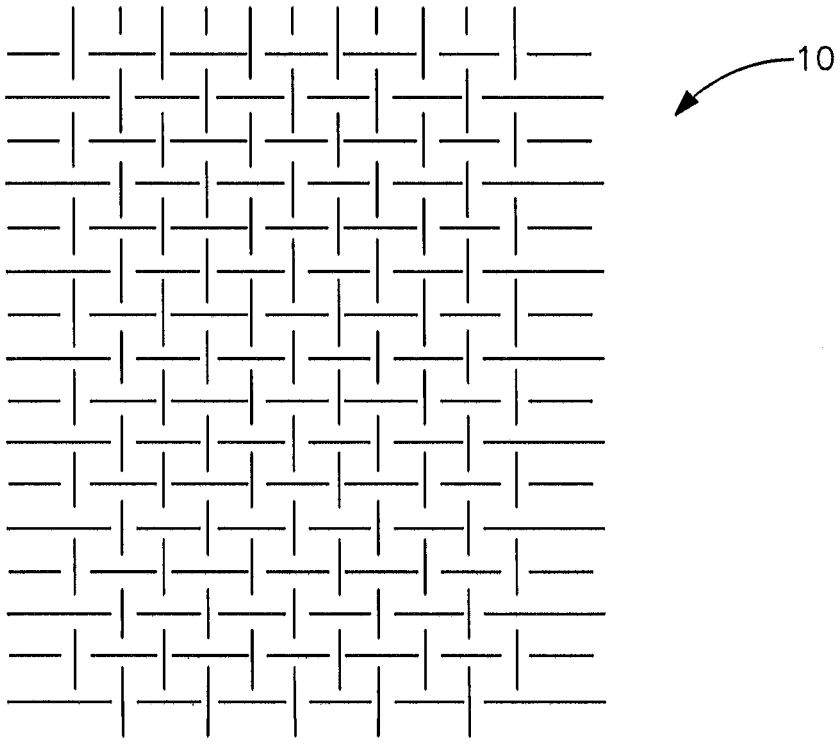
FIG. 1 shows a single layer plain weave construction of the same filament in warp and weft directions.
Figure 2:
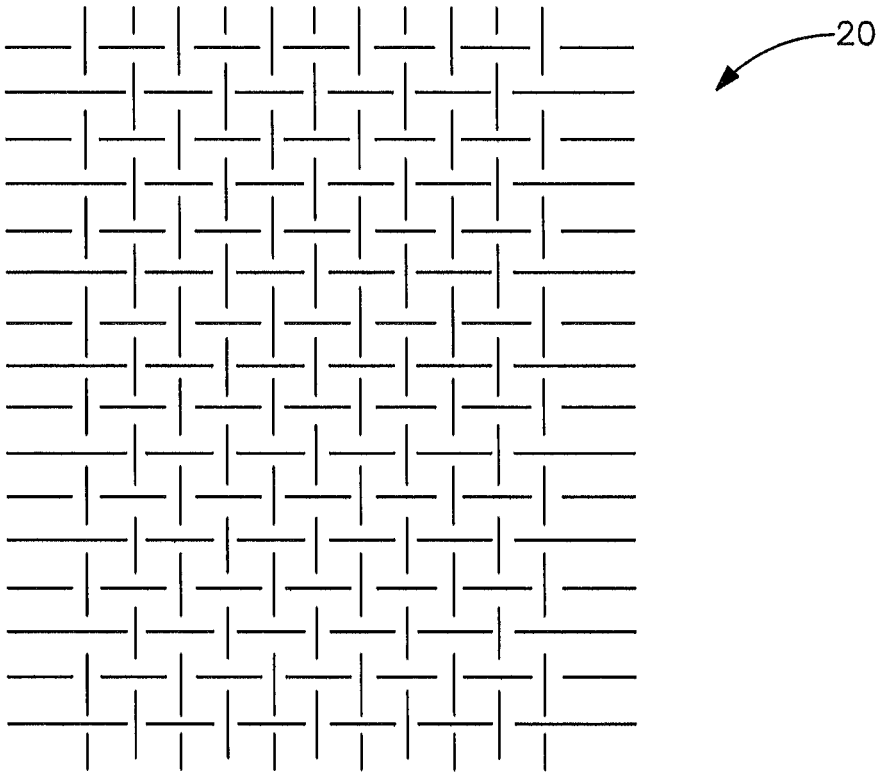
FIG. 2 shows a single layer plain weave construction of alternating filaments both in warp and weft directions.
Figure 3:
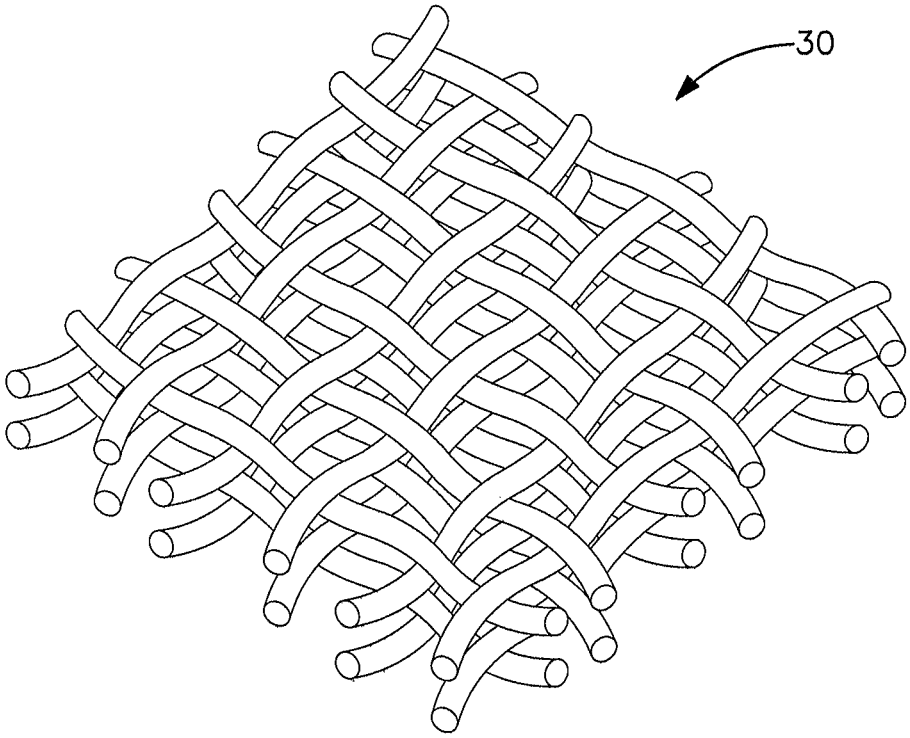
FIG. 3 shows a two layer stacking of two single layer plain weave constructions.

FIG. 1 shows a single layer plain weave construction 10 according to one embodiment of the invention in which the same filament is used in warp and weft directions. FIG. 2 shows a single layer plain weave construction 20 according to one embodiment of the invention in which alternating filaments are used both in warp and weft directions. FIG. 3 shows a two layer stacking 30 of two single layer plain weave constructions according to one embodiment of the invention.

The invention will be described in connection with the following examples which are intended to illustrate, but not limit the scope of, the invention.

EXAMPLES

This is a summary of the current V-50 2-grain fragmentary ballistic results on experimental ballistic resistant fabric (textile) for use in applications such as in a PUG. The experimental textile comprises expanded PTFE filaments or expanded PTFE multifilaments (e.g., towed monofilaments) as well as component yarn assemblies consisting of an ePTFE and para-aramid filaments twisted together and component fabric weave design consisting of ePTFE and para-aramid filaments.

Example 1

Invention 100% 400 Denier ePTFE Multifilament 33×33, 1-Layer

A plain weave textile consisting of 33 ends per inch (epi) by 33 picks per inch (ppi) equivalent to 1300 epm by 1300 ppm textile composed of 400 denier (444 dtex) expanded PTFE multifilament part number V112939 available from W. L. Gore and Associates, Inc. Elkton, Md. Prior to weaving, the filament was twisted to 1.2 twists per inch (47.2 twists per meter) in a Z twist configuration using a ring spinning frame.

Example 2

Invention 100% 400 Denier ePTFE Multifilament 36×36, 1-Layer

A plain weave textile consisting of 36 ends per inch (epi) by 36 picks per inch (ppi) equivalent to 1417 epm by 1417 ppm textile composed of 400 denier (444 dtex) expanded PTFE multifilament part number V112939 available from W. L. Gore and Associates, Inc. Elkton, Md. Prior to weaving, the filament was twisted to 1.2 twists per inch (47.2 twists per meter) in a Z twist configuration using a ring spinning frame.

Example 3

Invention TWARON 550 DTEX/PTFE 444 DTEX 29×29 (Alternating Every Other End) 1-Layer A plain weave textile consisting of two filament materials woven at 29 ends per inch (epi) by 29 picks per inch (ppi) equivalent to 1142 epm by 1142 ppm textile. The filament materials were a 400 denier (444 dtex) expanded PTFE multifilament part number V112939 available from W. L. Gore and Associates, Inc. Elkton, Md. and 495 denier (550 dtex) paramide Twaron® available from Teijin Aramid Company, Conyers, Ga. The two materials were woven every other pick and every other end forming a balanced weave design. Prior to weaving, the 400 denier expanded PTFE filament was twisted to 1.2 twists per inch (47.2 twists per meter) in a Z twist configuration using a ring spinning frame. In this example the woven fabric is 45% ePTFE by weight.

Example 4

Invention TWARON 550 DTEX/PTFE 444 DTEX 14.5×14.5 (Twisted BLEND), 1-Layer

A plain weave textile consisting of blended twisted filament woven at 14.5 ends per inch (epi) by 14.5 picks per inch (ppi) equivalent to 571 epm by 571 ppm textile. A blended filament was made by ring twisting one end of a 400 denier (444 dtex) expanded PTFE multifilament part number V112939 available from W. L. Gore and Associates, Inc. Elkton, Md. and one end of a 495 denier (550 dtex) paramide Twaron® available from Teijin Aramid Company, Conyers, Ga. The ends were twisted together at 1.2 turns per inch (47.2 twists per meter) in a Z twist configuration. In this example the woven fabric is 45% ePTFE by weight.

Example 5

Invention 100% 400 Denier ePTFE Multifilament 40×40, 1-Layer

A plain weave textile consisting of 40 ends per inch (epi) by 40 picks per inch (ppi) equivalent to 1575 epm by 1575 ppm textile composed of 400 denier (444 dtex) expanded PTFE multifilament part number V112939 available from W. L. Gore and Associates, Inc. Elkton, Md. Prior to weaving, the filament was twisted to 1.2 twists per inch (47.2 twists per meter) in a Z twist configuration using a ring spinning frame.

Example 6

Invention 100% 400 Denier ePTFE Multifilament 45×45, 1-Layer

A plain weave textile consisting of 45 ends per inch (epi) by 45 picks per inch (ppi) equivalent to 1772 epm by 1772 ppm textile composed of 400 denier (444 dtex) expanded PTFE multifilament part number V112939 available from W. L. Gore and Associates, Inc. Elkton, Md. Prior to weaving, the filament was twisted to 1.2 twists per inch (47.2 twists per meter) in a Z twist configuration using a ring spinning frame.

Example 7

Invention 100% 400 Denier ePTFE Multifilament 33×33, 2-Layers

A plain weave textile consisting of 33 ends per inch (epi) by 33 picks per inch (ppi) equivalent to 1300 epm by 1300 ppm textile composed of 400 denier (444 dtex) expanded PTFE multifilament part number V112939 available from W. L. Gore and Associates, Inc. Elkton, Md., were combined together in a two layer stack measuring 15 inches×15 inches (381 mm×381 mm). Prior to weaving, the filament was twisted to 1.2 twists per inch (47.2 twists per meter) in a Z twist configuration using a ring spinning frame.

Example 8

Invention 100% 400 Denier ePTFE Multifilament 33×33, 3-Layers

A plain weave textile consisting of 33 ends per inch (epi) by 33 picks per inch (ppi) equivalent to 1300 epm by 1300 ppm textile composed of 400 denier (444 dtex) expanded PTFE multifilament part number V112939 available from W. L. Gore and Associates, Inc. Elkton, Md., were combined together in a three layer stack measuring 15 inches×15 inches (381 mm×381 mm). Prior to weaving, the filament was twisted to 1.2 twists per inch (47.2 twists per meter) in a Z twist configuration using a ring spinning frame.

Example 9

Invention 100% 400 Denier ePTFE Multifilament 36×36, 2-Layers

A plain weave textile consisting of 36 ends per inch (epi) by 36 picks per inch (ppi) equivalent to 1417 epm by 1417 ppm textile composed of 400 denier (444 dtex) expanded PTFE multifilament part number V112939 available from W. L. Gore and Associates, Inc. Elkton, Md., were combined together in a two layer stack measuring 15 inches×15 inches (381 mm×381 mm). Prior to weaving, the filament was twisted to 1.2 twists per inch (47.2 twists per meter) in a Z twist configuration using a ring spinning frame.

Example 10

Invention 100% 400 Denier ePTFE Multifilament 36×36, 3-Layers

A plain weave textile consisting of 36 ends per inch (epi) by 36 picks per inch (ppi) equivalent to 1417 epm by 1417 ppm textile composed of 400 denier (444 dtex) expanded PTFE multifilament part number V112939 available from W. L. Gore and Associates, Inc. Elkton, Md., were combined together in a three layer stack measuring 15 inches×15 inches (381 mm×381 mm). Prior to weaving, the filament was twisted to 1.2 twists per inch (47.2 twists per meter) in a Z twist configuration using a ring spinning frame.

Example 11

(Invention) TWARON 550 DTEX/PTFE 444 DTEX 29×29 (Alternating Every Other End) 2-Layers A plain weave textile consisting of two filament materials woven at 29 ends per inch (epi) by 29 picks per inch (ppi) equivalent to 1142 epm by 1142 ppm textile. The filament materials were a 400 denier (444 dtex) expanded PTFE multifilament part number V112939 available from W. L. Gore and Associates, Inc. Elkton, Md. and 495 denier (550 dtex) paramide Twaron® available from Teijin Aramid Company, Conyers, Ga. The two materials were woven every other pick and every other end forming a balanced weave design. Prior to weaving, the 400 denier expanded PTFE filament was twisted to 1.2 twists per inch (47.2 twists per meter) in a Z twist configuration using a ring spinning frame. Two woven pieces were combined together to form a two layer stack measuring 15 inches×15 inches (381 mm×381 mm). In this example the woven fabric is 45% ePTFE by weight.

Example 12

Invention TWARON 550 DTEX/PTFE 444 DTEX 29×29 (Alternating Every Other End) 3-Layers A plain weave textile consisting of two filament materials woven at 29 ends per inch (epi) by 29 picks per inch (ppi) equivalent to 1142 epm by 1142 ppm textile. The filament materials were a 400 denier (444 dtex) expanded PTFE multifilament part number V112939 available from W. L. Gore and Associates, Inc. Elkton, Md. and 495 denier (550 dtex) paramide Twaron® available from Teijin Aramid Company, Conyers, Ga. The two materials were woven every other pick and every other end forming a balanced weave design. Prior to weaving, the 400 denier expanded PTFE filament was twisted to 1.2 twists per inch (47.2 twists per meter) in a Z twist configuration using a ring spinning frame. Three woven pieces were combined together to form a three layer stack measuring 15 inches×15 inches (381 mm×381 mm). In this example the woven fabric is 45% ePTFE by weight.

Example 13

Invention TWARON 550 DTEX/PTFE 444 DTEX 14.5×14.5 (Twisted BLEND), 2-Layers

A plain weave textile consisting of blended twisted filament woven at 14.5 ends per inch (epi) by 14.5 picks per inch (ppi) equivalent to 571 epm by 571 ppm textile. A blended filament was made by ring twisting one end of a 400 denier (444 dtex) expanded PTFE multifilament part number V112939 available from W. L. Gore and Associates, Inc. Elkton, Md. and one end of a 495 denier (550 dtex) paramide Twaron® available from Teijin Aramid Company, Conyers, Ga. The ends were twisted together at 1.2 turns per inch (47.2 twists per meter) in a Z twist configuration. Two woven pieces were combined together to form a two layer stack measuring 15 inches×15 inches (381 mm×381 mm). In this example the woven fabric is 45% ePTFE by weight.

Example 14

Invention TWARON 550 DTEX/PTFE 444 DTEX 14.5×14.5 (Twisted BLEND), 3-Layers

A plain weave textile consisting of blended twisted filament woven at 14.5 ends per inch (epi) by 14.5 picks per inch (ppi) equivalent to 571 epm by 571 ppm textile. A blended filament was made by ring twisting one end of a 400 denier (444 dtex) expanded PTFE multifilament part number V112939 available from W. L. Gore and Associates, Inc.

Elkton, Md. and one end of a 495 denier (550 dtex) paramide Twaron® available from Teijin Aramid Company, Conyers, Ga. The ends were twisted together at 1.2 turns per inch (47.2 twists per meter) in a Z twist configuration. Three woven pieces were combined together to form a three layer stack measuring 15 inches×15 inches (381 mm×381 mm). In this example the woven fabric is 45% ePTFE by weight.

Example 15

Invention 100% 400 Denier ePTFE Multifilament 40×40, 3-Layers

A plain weave textile consisting of 40 ends per inch (epi) by 40 picks per inch (ppi) equivalent to 1575 epm by 1575 ppm textile composed of 400 denier (444 dtex) expanded PTFE multifilament part number V112939 available from W. L. Gore and Associates, Inc. Elkton, Md., were combined together in a three layer stack measuring 15 inches×15 inches (381 mm×381 mm). Prior to weaving, the filament was twisted to 1.2 twists per inch (47.2 twists per meter) in a Z twist configuration using a ring spinning frame.

Example 16

Invention 100% 400 Denier ePTFE Multifilament 45×45, 3-Layers

A plain weave textile consisting of 45 ends per inch (epi) by 45 picks per inch (ppi) equivalent to 1772 epm by 1772 ppm textile composed of 400 denier (444 dtex) expanded PTFE multifilament part number V112939 available from W. L. Gore and Associates, Inc. Elkton, Md., were combined together in a three layer stack measuring 15 inches×15 inches (381 mm×381 mm). Prior to weaving, the filament was twisted to 1.2 twists per inch (47.2 twists per meter) in a Z twist configuration using a ring spinning frame.

Kawabata Test Method for Comfort

Kawabata Hand is a function of 16 different data statistics or parameters in which the fabric is tested. The mechanical properties tested are listed in Table 1.

TABLE 1

Fabric Mechanical Properties of Kawabata Hand.

| Property | Parameter | Description |
|---|---|---|
| Tensile | LT | Linearity of load-extension curve |
| Strength | WT | Tensile Energy (g cm/cm$^2$) |
| | RT | Tensile Resilience (%) |
| | EMT | Higher value indicates greater extension resulting in improves comfort during movement of wearer. |
| Shear | G | Shear Rigidity (g/cm degree). Lower values compare to less resistance to shear and offering wearer better comfort due to ease of movement. |
| | 2HG | Hysteresis of shear force at 0.5 degrees (g/cm) |
| | 2HG5 | Hysteresis of shear force at 5 degrees (g/cm) |
| Bending | B | Bending Rigidity (g cm$^2$/cm) Lower values correspond to greater ease of movement and comfort due to less resistance to bending. |
| | 2HB | Hysteresis of bending moment (g cm/cm) |
| Compression | LC | Linearity of compression-thickness curve |
| | WC | Energy of Compression (g cm/cm$^2$) |
| | RC | Resilience to Compression (%) |
| Surface | MIU | Coefficient of Friction |
| | MMD | Mean Deviation of Coefficient of Friction |
| | SMD | Geometrical roughness (μm) |
| Fabric construction | W | Fabric weight per unit area (mg/cm$^2$) |
| | T | Fabric Thickness (mm) |

The fabric under analysis was subjected to the five tests above and the results were compared against the other candidates in the study to determine its relative hand. The various tests were conducted on single layer test swatches, 20×20 cm. The warp direction and the fabric face side were marked to maintain proper orientation of the sample during testing. Standard conditions were used in the set-up. Table 2 lists the standard conditions used in the Kawabata testing.

TABLE 2

Kawabata Standard Condition Settings

| Apparatus Setting | Tensile | Shear | Bending | Compression | Surface |
|---|---|---|---|---|---|
| Sensitivity | 5 × 5 | 2 × 5 | 2 × 1 | 2 × 5 | 2 × 5 |
| Velocity | 0.2 mm/sec | | | 50 sec/mm | 1.0 mm/sec |
| Sample Width (cm) | 20 | 20 | 20 | | |
| Clamp Interval (cm) | 5 | 5 | | | |
| Elongation Sensitivity | 25 mm/10 V | | | | |
| Maximum Load | 50 gf/cm | | | | |
| Tensile-Preset | 2 | | | | |
| Maximum Shear Angle | | +8.0 to −8.0 | | | |
| Hysteresis | | 2HG = 0.5 | 2HB | | |
| Shear Tension | | 2HG5 = 5.0 | K = 1.0 cm−1 | | |
| | | G = 0.5 to 2.5 | | | |
| | | 10 gf/cm | | | |
| Bending Rigidity | | | B K = 0.5 to 1.5 cm −1 | | |
| Compressing Area | | | | 2 cm2 | |
| Stroke Selection | | | | 5 mm/10 V | |
| Maximum Load (Fm) | | | | 50 gf/cm2 | |
| FM Set Dial | | | | 5 | |
| Roughness contractor comp | | | | | 10gf |

Particular attention is drawn to the bending and shear property results. A garment made of fabric that requires less force to bend is expected to be more comfortable especially for fabrics deployed for undergarments than fabrics that require high force to bend.

The results of the Kawabata Evaluation System (KES) are shown in Tables 3 and 4. Table 3 contains the single layer results of the warp direction for examples 1 to 4 and Table 4 contains the single layer results of the weft direction for examples 1 to 4.

TABLE 3

Kawabata Evaluation System Single Layer WARP Results

| Single Layer | | EXAMPLE 1 100% PTFE | 2 100% PTFE | 3 PTFE-Para aramid Alternating | 4 PTFE-Para aramid Twisted |
|---|---|---|---|---|---|
| WARP | weave | 33 × 33 | 36 × 36 | 29 × 29 | 14.5 × 14.5 |
| TENSILE | LT | 0.627 | 0.723 | 0.527 | 0.519 |
| | WT | 2.97 | 2.75 | 2.38 | 2.1 |
| | RT | 37.63 | 32.71 | 41.61 | 43.64 |
| | EMT | 1.9 | 1.52 | 1.91 | 1.62 |
| SHEAR | G | 0.23 | 0.25 | 0.48 | 0.33 |
| | 2HG | 0.28 | 0.47 | 2.7 | 0.9 |
| | 2HG5 | 0.42 | 0.68 | 2.84 | 1.02 |
| BENDING | B | 0.063 | 0.0736 | 0.1951 | 0.1703 |
| | 2HB | 0.1477 | 0.1901 | 0.5144 | 0.3555 |
| COM-PRESSION | LC | 0.343 | 0.45 | 0.235 | 0.369 |
| | WC | 0.064 | 0.065 | 0.145 | 0.122 |
| | RC | 12.55 | 25.23 | 40.69 | 33.52 |
| | T0 | 0.336 | 0.326 | 0.654 | 0.482 |
| | TM | 0.261 | 0.267 | 0.351 | 0.351 |
| SURFACE | MIU | 0.419 | 0.39 | 0.313 | 0.671 |
| | MMD | 0.039 | 0.0421 | 0.0359 | 0.0397 |
| | SMD | 11.662 | 9.515 | 9.377 | 9.9 |

TABLE 4

Kawabata Evaluation System Single Layer WEFT Results

| Single Layer | | EXAMPLE 1 100% PTFE | 2 100% PTFE | 3 PTFE-Para aramid Alternating | 4 PTFE-Para aramid Twisted |
|---|---|---|---|---|---|
| WEFT | weave | 33 × 33 | 36 × 36 | 29 × 29 | 14.5 × 14.5 |
| TENSILE | LT | 0.589 | 0.668 | 0.566 | 0.527 |
| | WT | 4 | 4.6 | 3.97 | 2.12 |
| | RT | 25.02 | 26.65 | 27.46 | 43.94 |
| | EMT | 2.72 | 2.75 | 2.82 | 1.63 |
| SHEAR | G | 0.25 | 0.26 | 0.41 | 0.31 |
| | 2HG | 0.31 | 0.5 | 2.6 | 0.85 |
| | 2HG5 | 0.47 | 0.74 | 2.89 | 0.92 |
| BENDING | B | 0.0588 | 0.0534 | 0.2275 | 0.178 |
| | 2HB | 0.1357 | 0.1562 | 0.4544 | 0.305 |
| COM-PRESSION | LC | 0.343 | 0.45 | 0.235 | 0.369 |
| | WC | 0.064 | 0.065 | 0.145 | 0.122 |
| | RC | 12.55 | 25.23 | 40.69 | 33.52 |
| | T0 | 0.336 | 0.326 | 0.654 | 0.482 |
| | TM | 0.261 | 0.267 | 0.351 | 0.351 |
| SURFACE | MIU | 0.309 | 0.239 | 0.24 | 0.621 |
| | MMD | 0.0421 | 0.0491 | 0.028 | 0.035 |
| | SMD | 12.872 | 11.747 | 12.17 | 10.058 |

FAST Test Method and Results

FAST is an assessment system for quickly evaluating fabric appearance, hand, and performance properties objectively developed by Commonwealth Scientific & Industrial Research Organization (CSIRO) Division of Wool Technology—Sydney Laboratory, Sydney, Australia. The test was specifically designed for the garment industry and worsted-wool finishers. One test of the FAST assessment system, FAST-2 bending, was used to measure the bending of single, double, and triple stacked layers. Test specimens measuring 49.5 mm by 200 mm were cut from bolts of the present invention both in the weft and warp directions. The test specimen strips were placed in a 51 mm wide, by 200 mm pouch consisting of circular knitted nylon material that had been conditioned through a 25° C. 10-minute wash cycle five times and air-dried. The bending test apparatus developed by CSIRO contains a photocell, which detects the fabric as it bends to a 41.5° angle deflecting from the horizontal plane. The length of the fabric required to be deflected reaching the test angle is measured by a rotary pulse encoder indirectly coupled to the test fabric through a flat aluminum bar resting over the test sample and encoder wheel. Equation 1 is used to calculate the bending force based on the bending length measured by the FAST bending apparatus as referenced in British Standard BS:3356 (1990), *Method for determination of bending length and flexural rigidity of fabrics.*

$$\text{Bending_Rigidity} = \text{Weight} \times (\text{Bending_Length})^3 \times 9.807 \times 10^{-6} \quad \text{Eq. 1}$$

where: Bending Rigidity in μNm

Bending Length in mm

Fabric Weight in $g/m^2$

A property that is useful to the undergarment maker is bending rigidity. As described in the section regarding the Kawabata evaluation, a textile or fabric, which shows less rigidity to bending, would be useful for undergarments. Unlike the Kawabata system of testing, multiple layers may be combined together in the FAST-2 and the bending length can be measured. The bending forces measured by the Kawabata tests tend to be more precise than the FAST-2 test due to the use of actual load cells measuring the force to bend the fabric in Kawabata. The FAST-2 bending test permits the measuring of multiple layers and coupled with the bending forces measured by Kawabata for single layers, a sense or direction of where the Kawabata bending results would be for multiple layers can be achieved by the use of the FAST-2 data.

The results of the FAST-2 bending tests are shown in Tables 5 with bending rigidity calculated using Equation 1.

TABLE 5

FAST-2 Bending (per BS:3356 (1990)) and Bending Rigidity Results

| Example | # of Layers | Orientation | Single layer weight (g/m2) | Bending Length (mm) | Bending Rigidity (μNm) | Std Dev. Bending Rigidity (μNm) | Warp/Weft Average (μNm) | Warp/Weft Std. Dev. (μNm) |
|---|---|---|---|---|---|---|---|---|
| 7 | 2 | Warp | 116 | 21 | 10.1 | 0.83 | | |
| 7 | 2 | Weft | 116 | 22 | 10.6 | 1.34 | 10.3 | 0.36 |
| 8 | 3 | Warp | 116 | 22 | 12.7 | 1.00 | | |
| 8 | 3 | Weft | 116 | 19.5 | 8.7 | 1.02 | 10.7 | 2.84 |
| 9 | 2 | Warp | 126 | 22.5 | 12.1 | 4.27 | | |
| 9 | 2 | Weft | 126 | 20.5 | 10.1 | 4.29 | 11.1 | 1.42 |
| 10 | 3 | Warp | 126 | 18.5 | 13.6 | 4.40 | | |
| 10 | 3 | Weft | 126 | 24 | 16.1 | 1.74 | 14.8 | 1.78 |
| 3 | 1 | Warp | 115 | 21.5 | 14.6 | 4.57 | | |
| 3 | 1 | Weft | 115 | 21.5 | 13.5 | 2.20 | 14.1 | 0.79 |
| 11 | 2 | Warp | 115 | 32.5 | 28.9 | 10.63 | | |
| 11 | 2 | Weft | 115 | 26 | 23.2 | 3.93 | 26.1 | 4.07 |
| 12 | 3 | Warp | 115 | 32.5 | 38.7 | 1.79 | | |
| 12 | 3 | Weft | 115 | 31 | 32.6 | 3.26 | 35.7 | 4.34 |
| 4 | 1 | Weft | 115 | 22.5 | 14.2 | 1.94 | 14.2 | n/a |
| 13 | 2 | Warp | 115 | 22 | 12.0 | 0.01 | | |
| 13 | 2 | Weft | 115 | 21 | 14.1 | 5.02 | 13.1 | 1.47 |
| 14 | 3 | Warp | 115 | 27.5 | 23.5 | 0.01 | | |
| 14 | 3 | Weft | 115 | 23.5 | 12.9 | 2.42 | 18.2 | 7.45 |

2-Grain V-50 Fragmentation Resistance Test Method Description and Results

A right circular cylinder or RCC simulator metal fragment weighing 2 grains is shot from a laboratory rifle towards the PUG article from a distance of 9.5 feet (2.9 m). The rifle muzzle velocity is measured as well as the velocity of the fragment before striking the target. The RCC velocity was determined using two IR chronographs available from Oehler Research, Inc. Austin, Tex. positioned at 1.52 m and 3.05 m from the front of the panel. The velocity of the 2 grain RCC striking the panel was calculated at a distance of 2.29 m from the panel. A minimum of eight shots are fired at the target stack. If the projectile completely penetrates the target and through the witness panel located behind the target, it is identified as complete. If the projectile does not completely penetrate the target, it is identified as partial.

To determine the V-50 statistic, the velocities associated with an equal number of complete and partial penetrations were averaged. All of the velocities used to determine V-50 must fall within a range of 150 ft/sec (45.7 m/sec) of each other. When it is necessary to choose between velocities, the highest partial penetrations and lowest complete penetrations that fall within the 150 ft/sec (45.7 m/sec) tolerance are used in the calculation. The V-50 statistic is then calculated from the average of these shot velocities. Preferably, the calculation is based on at least three "partial" shots and three "complete" penetrations.

Equation 2 defines V-50 in a mathematical formula using the preferred method. The projectile velocities used in the V-50 statistic are calculated velocities using the two IR chronographs described above and the units are in feet per second. Various layers of the protective textile may be combined together. The goal is to achieve a sufficiently high V-50 value with the least amount of textile layers and weight. The textile is placed under a 70 denier nylon rip stop woven cover and mounted prior to the test firing. Additional parameters for the V50 statistic follow: The spacing between the witness panel located behind the target is 6 inches (152.4 mm), shot spacing is 16-shot, midpoint to target is 3 inches, (76 mm) obliquity is 0 degrees, the gun powder is available from Bullseye, the test sample is dry and the temperature of the testing room is ambient. Table 6 contains the V-50 ballistic test results.

$$V50 = \left( \frac{\sum_{i=1}^{3} \text{Velocity}_{lowest_complete_penetration}\, i + \sum_{j=1}^{3} \text{Velocity}_{highest_partial_pentration}\, j}{2} \right) \quad \text{Eq. 2}$$

TABLE 6

V-50 Results and Fabric Weights

| Example | V-50 (fps) | Layers | $V_{highest\ partial\ penetration}$ (fps) | $V_{lowest_complete\ pentration}$ (fps) | Weight (g/m$^2$) |
|---|---|---|---|---|---|
| 7 | 799 | 2 | 869 | 773 | 116 |
| 8 | 802 | 3 | 860 | 786 | 116 |
| 8 | 817 | 3 | 831 | 753 | 116 |
| 10 | 850 | 3 | 828 | 874 | 126 |
| 11 | 814 | 2 | 862 | 766 | 115 |
| 12 | 941 | 3 | 932 | 917 | 115 |
| 14 | 794 | 3 | 766 | 823 | 115 |
| 15 | 891 | 3 | 868 | 874 | 140 |
| 16 | 953 | 3 | 955 | 915 | 158 |

Vertical Wicking

Figure 4:
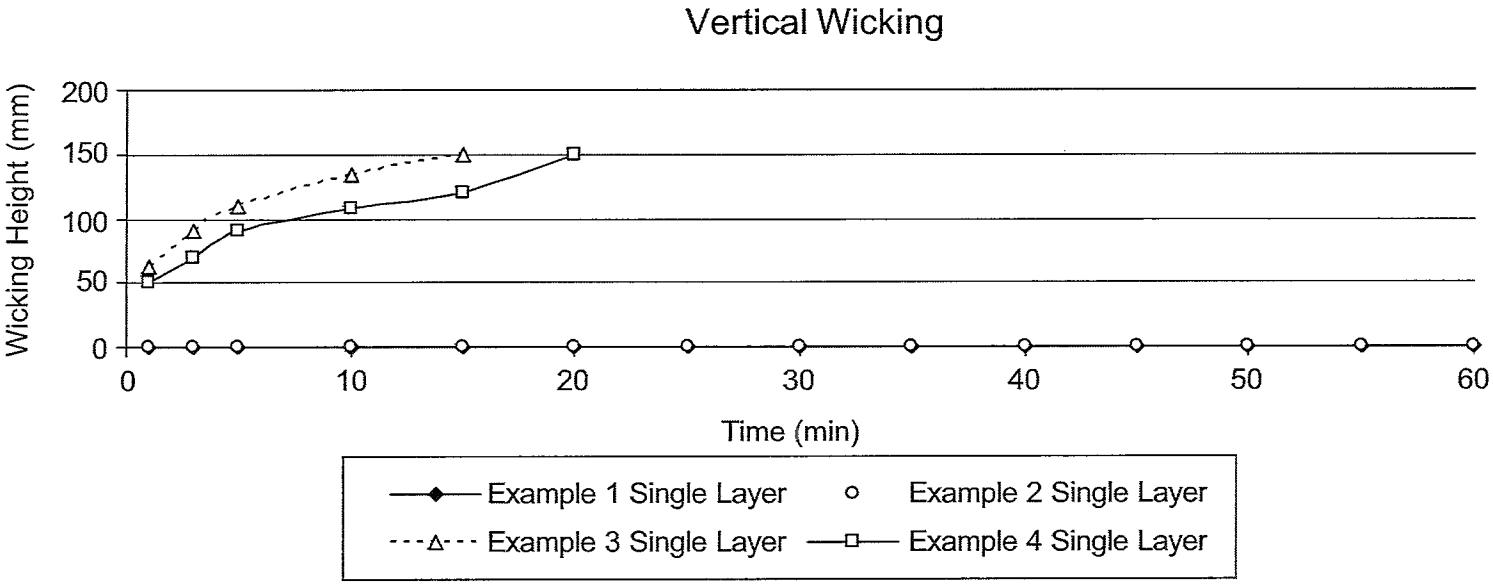
FIG. 4 is a plot of the vertical wicking height versus time of single layers for Examples 1, 2, 3, and 4.

The amount of liquid water which is able to wick in the fabrics was investigated by vertically suspending a 1 inch (25.4 mm) wide sample 8 inches (203 mm) in length and submerged 1 inch (25.4 mm) in distilled water at ambient temperature and observing the wick height at time periods starting from the initial immersion of 1, 3, and 5 minutes and thereafter each 5 minute interval for 60 minutes or an observed wick height of 150 mm whichever is first to be achieved. FIG. 4 is a plot of the vertical wicking height versus time of single layers for Examples 1, 2, 3, and 4. No observable wicking of the distilled water was shown in the examples consisting of single layer 100% ePTFE fabrics, namely Examples 1 and 2. Wicking was observed for the examples of a single layer textile comprised of a twisted para-aramid and ePTFE multifilament namely Example 4 and the single layer textile consisting of alternating ePTFE multifilaments and para-aramid filaments namely Example 3.

Bacteria growth is facilitated by the presence of water. A fabric possessing the capability of minimal to no water wicking is thought to minimize the likelihood for bacterial growth within the fabric or textile. It is expected that the present invention will possess minimal bacterial growth in view of the minimal water wicking characteristic shown in examples 1 and 2 in the above results.

Air Permeability Rate

The air permeability transmission rate of single layers used in Examples 1, 2, 3, and 4 were measured in accordance to ASTM D737-04 *Air Permeability of Textile Fabrics* test method. The test pressure was 125 Pascal and five air flow measurements were taken per sample. Table 7 contains the results of the air permeability tests.

TABLE 7

Air Permeability of Single Layer Results

| Example | # Layers | N | Average Air Permeability (CFM) | Std. Dev. Air Permeability (CFM) |
|---|---|---|---|---|
| 1 | 1 | 5 | 193.4 | 5.5 |
| 2 | 1 | 5 | 157.4 | 31.8 |
| 3 | 1 | 5 | 113.2 | 9.3 |
| 4 | 1 | 5 | 449.8 | 93.6 |

Note:
Test pressure 125 Pa, per ASTM D737

Discussion

Using a textile comprising of 100% 400 denier ePTFE multifilament at various pick and end densities is shown to offer excellent fragmentary ballistic protection, not wick distilled water, bend with minimal force and exhibit excellent air permeability compared to traditional ballistic textile composed of para-aramid filaments.

What is claimed is:

1. An article comprising an insert for a protective garment, said insert comprising a fabric having at least 45 percent by weight of expanded polytetrafluoroethylene fibers, said fabric having a 2-Grain V-50 Fragmentation Resistance of at least 700 feet per second and a FAST-2 Bending Rigidity of less than 40 microNewtonmeters; and said fabric having a weight of less than 160 grams per square meter.

2. An article as defined in claim 1 wherein said fabric has at least 75 percent by weight of polytetrafluoroethylene fibers.

3. An article as defined in claim 1 wherein said fabric comprises 100 percent by weight of polytetrafluoroethylene fibers.

4. An article as defined in claim 1 wherein said fabric has a 2-Grain V-50 Fragmentation Resistance of at least 800 feet per second.

5. An article as defined in claim 1 wherein said fabric has a Vertical Wicking after 10 minutes of less than 150 mm.

6. An article as defined in claim 1 wherein said fabric has a Vertical Wicking after 10 minutes of zero mm.

7. An article as defined in claim 1 wherein said FAST-2 Bending Rigidity is less than 30 microNewtonmeters.

8. An article as defined in claim 1 wherein said FAST-2 Bending Rigidity is less than 20 microNewtonmeters.

9. An article as defined in claim 1 wherein said FAST-2 Bending Rigidity is about 10 microNewtonmeters.

10. An article comprising an insert for a protective garment, said insert comprising a fabric having at least 45 percent by weight of expanded polytetrafluoroethylene filaments having a tenacity of less than 10 grams per dtex, said fabric having a 2-Grain V-50 Fragmentation Resistance of at least 700 feet per second and said fabric having a weight of less than 160 grams per square meter.

11. An article as defined in claim 10 wherein said fabric has at least 75 percent by weight of polytetrafluoroethylene filaments.

12. An article as defined in claim 10 wherein said fabric comprises 100 percent by weight of polytetrafluoroethylene filaments.

13. An article as defined in claim 10 wherein said fabric has a 2-Grain V-50 Fragmentation Resistance of at least 800 feet per second.

14. An article as defined in claim 10 wherein said fabric has a Vertical Wicking after 10 minutes of less than 150 mm.

15. An article as defined in claim 10 wherein said fabric has a Vertical Wicking after 10 minutes of zero mm.

16. An article as defined in claim 10 wherein said fabric has a weight of less than 140 grams per square meter.

17. An article as defined in claim 10 wherein said fabric has a weight of less than 120 grams per square meter.

* * * * *